United States Patent [19]

Denaro

[11] 3,957,069

[45] May 18, 1976

[54] EXPANDIBLE PLUGS FOR SECURING A TENT

[76] Inventor: Salvatore Denaro, 133 Westmont Ave., Toronto, Ontario, Canada

[22] Filed: Apr. 7, 1975

[21] Appl. No.: 565,399

[52] U.S. Cl. ..... 135/15 PE; 52/155; 85/87

[51] Int. Cl.[2] ..... A45F 1/16

[58] Field of Search..... 135/15 PE; 52/155, 161; 85/68, 84, 85, 87

[56] References Cited

UNITED STATES PATENTS

| | | | |
|---|---|---|---|
| 1,805,084 | 5/1931 | Gianini | 52/161 |
| 2,420,898 | 5/1947 | Miner | 135/15 PE |
| 3,503,298 | 3/1970 | Van Thiel | 85/87 |

FOREIGN PATENTS OR APPLICATIONS

| | | | |
|---|---|---|---|
| 533,826 | 11/1927 | Australia | 135/15 PE |
| 1,104,458 | 2/1968 | United Kingdom | 135/15 PE |

*Primary Examiner*—Werner H. Schroeder
*Assistant Examiner*—Conrad L. Berman
*Attorney, Agent, or Firm*—George H. Riches and Associates

[57] ABSTRACT

This invention discloses a novel collapsible tent which is designed to reduce the humidity therein and which utilizes novel ground-holding means to hold it securely to the ground when erected. The tent covering comprises separate inflatable sections which is suspended over a triangular tent-type configuration of tubular support pieces. The tent is secured to the ground by utilizing expandible plugs which comprise a tapering casing with an expandible ring on its lower section. The casing is inserted into the ground and a screw-type device is inserted therein. This causes the casing to expand and to apply radial pressure to the ground thus providing a secure connection to the ground. The tent also utilizes novel eave troughs which are designed to be able to be used as a carrying case for the tubular support pieces once disassembled.

5 Claims, 11 Drawing Figures

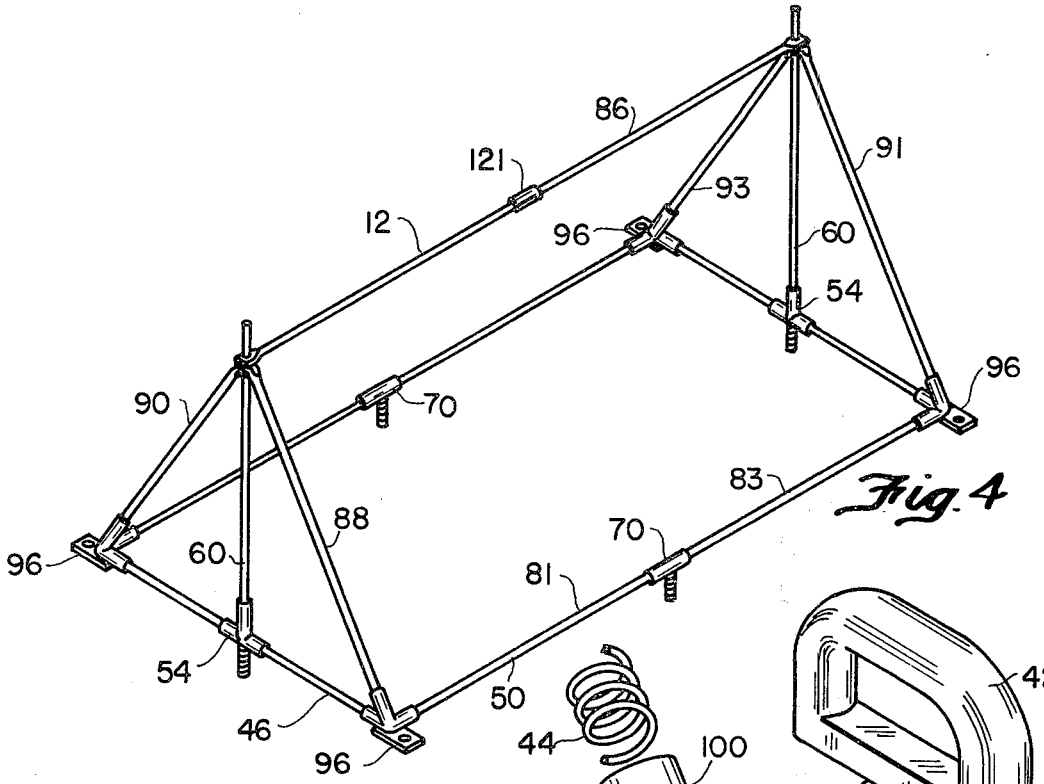
Fig. 4
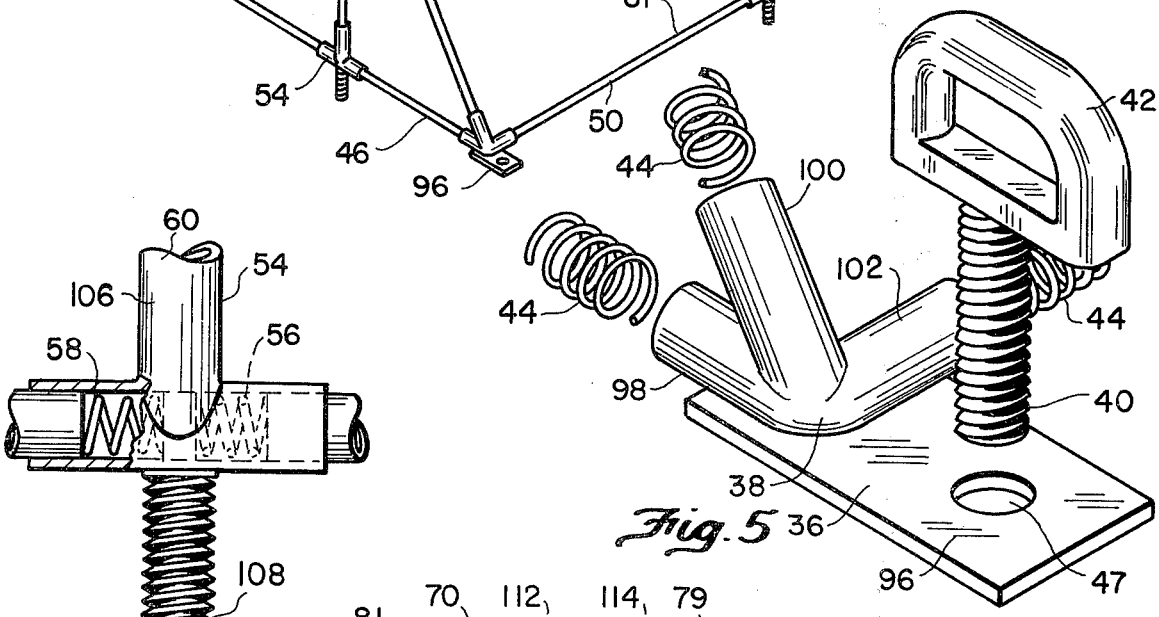
Fig. 5
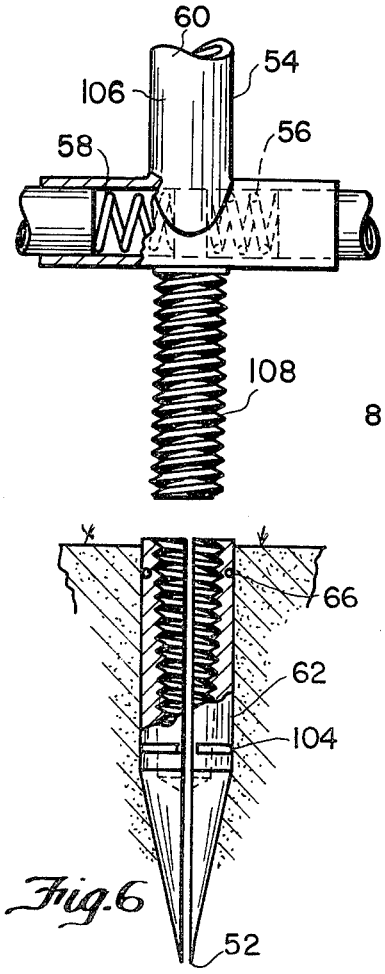
Fig. 6
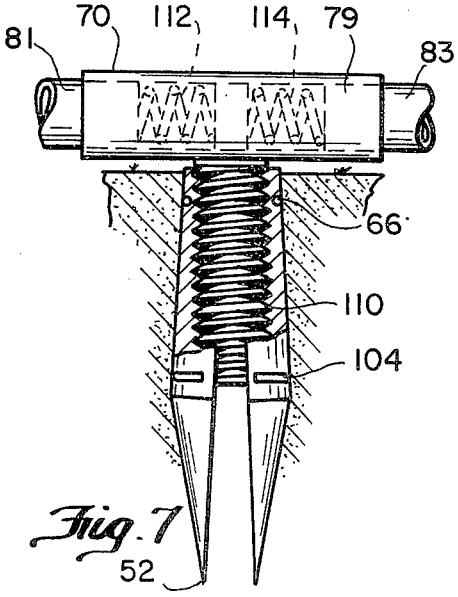
Fig. 7
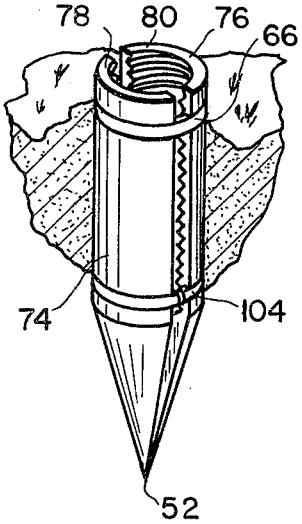

EXPANDIBLE PLUGS FOR SECURING A TENT

BACKGROUND OF THE INVENTION

This invention relates generally to a collapsible tent of novel construction which reduces the humidity normally encountered in camping tents, is quite easy to assemble and to erect, and when assembled, is securely held to the ground.

In the past, tents have been constructed of many different shapes and sizes and of different materials. Various means have been provided for holding these tents erect and stationary with a minimum of expertise necessary for the erection thereof while still achieving the stability which is required in normal use.

One of the chief problems encountered is an abnormally high degree of humidity found in the normal tent. High humidity especially coupled with high temperatures provides a rather uncomfortable atmosphere for a person within a tent and severe discomfort to others who may be suffering from certain medical conditions which require a relatively dry atmosphere.

Several suggestions to overcome the problem of humidity have been put forth but the reduction of humidity within a tent has always been accompanied by a marked increase in the complexity of the construction of the tent and therefore a decrease in its practicality.

Prior suggestions to overcome these problems have included inflatable shelters which are inflated by pumping air into the entire interior of the structure. The humidity of the air introduced therein could be controlled but these structures were objectionable due to the necessary large amounts of air required and the time required to inflate the tent. Air locks were necessary also to maintain sufficient interior pressure and easy accessibility was therefore impossible.

Self-supporting inflatable structures have also been suggested with individually inflatable frameworks and separable inflatable insulating walls. Problems associated with these structures have included a rather complicated frame structure to hold the inflatable structure as well as complicated means of securing the tent in a stationary position to the ground. The tents of these constructions have not been able to control the humidity within the tent nor have they generally provided an easy assembly procedure.

A further problem associated with tents is that the means of securing the frame of the tent to the ground does not securely hold the frame in place. It is rather important to fasten the tent securely in the event of wind or other conditions which might tend to collapse the tent. Various shapes of pegs and positioning of these pegs have been suggested but the problem has not been overcome.

Another problem associated with the tents of the prior art is the drainage problem which is caused by the rain as it strikes the sides of the tent and runs to the ground. If the quantity of rain is rather large, the water running off the sides of the tent tends to collect at the juncture point of the tent and the ground (assuming the tent was erected on relatively level ground). This collection of water in the area immediately in front of the tent is a nuisance to the campers. It is therefore a serious drawback of most of the tents of the prior art that no adequate drainage is provided to transport the water which tends to collect around the tent to an area removed from the tent.

Some of the tents of the prior art do provide a drainage system but the system provided is a separate and distinct system from the tent itself. To design a drainage system which would utilize a part or parts of the apparatus used in the transportation of the tent and/or the erection thereof would provide a most notable advance in the art.

SUMMARY OF THE INVENTION

Accordingly, it is an object of the present invention to provide a collapsible tent of easy construction.

Another object of the present invention is to provide a tent of easy construction which exhibits unexpected stability when assembled with relative ease.

A further object of the present invention is to provide a tent which will maintain the humidity of the air inside the tent at a relatively low level.

A further object of the present invention is to provide an expandible plug for securing a tent to the ground.

A still further object of the present invention is to provide a novel peg means for fastening guy wires into the ground to provide a secure fastening device for a tent.

A further object of the present invention is to provide a drainage system for a collapsible tent whereby the components used to transport the collapsed tent are adapted to function as a drainage system for the erected tent.

BRIEF DESCRIPTION OF THE DRAWINGS

Further objects of the present invention will become apparent from the following description taken together with the accompanying drawings, in which:

FIG. 4 is a perspective view of a tent frame for a tent according to the present invention;

FIG. 5 is an exploded view of a ground corner connector and plug;

FIG. 6 is an exploded cross-sectional view of an expandible plug according to the present invention;

FIG. 7 is an assembled cross-sectional view of a further embodiment of the plug of the present invention;

DESCRIPTION OF THE PREFERRED EMBODIMENT

The collapsible tent of the present invention comprises generally an inflatable covering 10 suspended about a frame 12. A window or screen 14 may be provided in one or both side walls of the covering 10. Guy wires 116,118 may be attached from each respective end of the tent to a peg driven into the ground to provide added strength.

Figure 2:
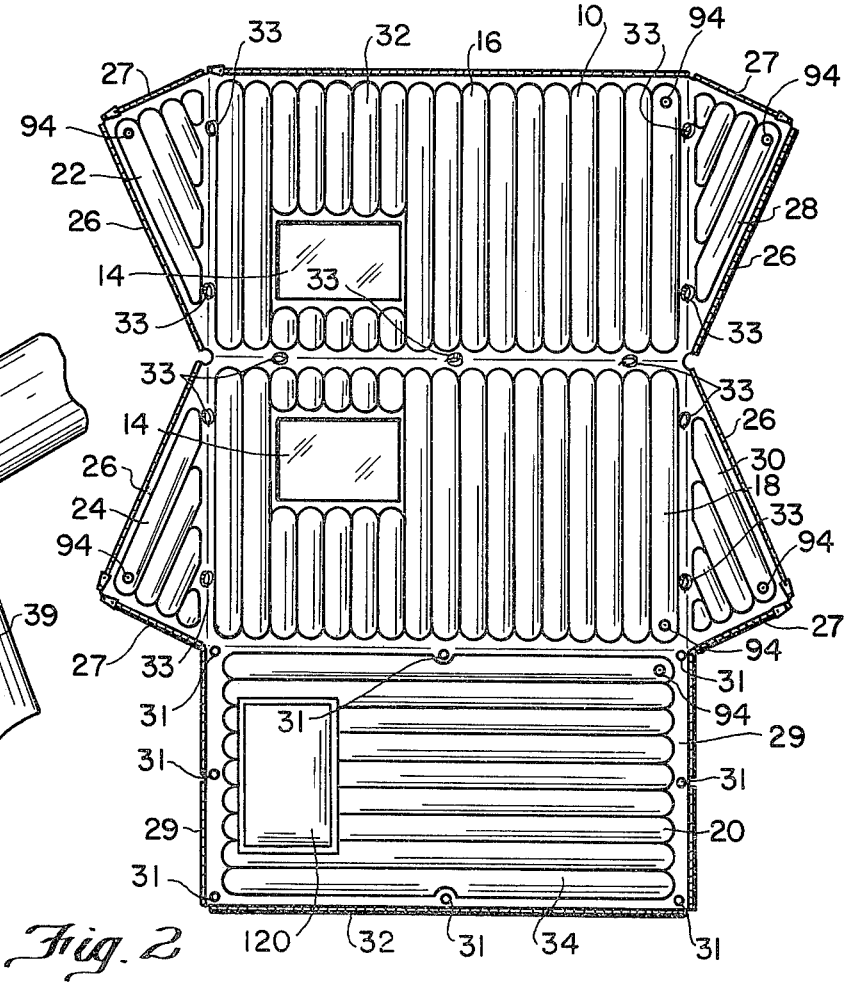
FIG. 2 is a plan view of the inflatable cover.

The inflatable covering 10 as shown in FIG. 2 comprises side portions 16,18, a floor portion 20, door portions 22,24 and 28,30 for front and rear doors. A zipper 26 is provided along the inside edge of door portions 22,28 and 24,30 so that when constructed, the doors may be closed by the zipper. A zipper 27 is also provided along the bottom edges of the door portions 22,28 and 24,30 and along the complementary edges 29 of the floor 20 so that the doors may be secured to the floor.

The covering 10 is constructed in a one-piece unit which provides great ease in storage, transportation and erection. The covering comprises a series of inflatable tubes with the side walls running in a substantially vertical direction and the tubes on the floor running in a horizontal direction.

Safety valves 94 may be provided at random on the surfaces of the covering to prevent over inflation of the tubes which may tend to occur when the temperature rises dramatically. These safety valves are constructed similar to those presently found in pneumatic mattresses. The inventor has found that seven such valves distributed evenly about the covering provide sufficient safety for normal use of the tent, one valve in each of the seven parts of the covering (as described hereinafter).

The covering 10 is divided up into seven basic sections as shown in FIG. 2, comprising side walls 16,18, floor portion 20, door portions 22,24,28 and 30. Each portion is inflatable independently of the other and is suspended over the rib frame 12 as shown in FIG. 4. The sections are so designed that if air escapes or is removed from any one or more sections for any reason, the covering 10 will still remain on the frame and the covering would still be operative.

In order to securely fasten the covering 10 to the rib frame 12, loops 33 are provided through which the appropriate portions of the rib frame 12 are inserted. These loops may be made of any suitable material and are affixed to the inside of the covering 10. The inventor has found that three loops across that part of the covering 10 which is placed over the tubular frame portion 86 is preferable and two loops placed on each part of the covering 10 which crosses tubular frame portions 88,90 and 91,93 is the preferable number.

There are five zipper systems found in the preferred embodiment of the present invention. One zipper systems 32 joins the floor portion 20 to the opposite side portion 16. Each door has one zipper system which joins the door portions 22 to 24 and 28 to 30 respectively. Each door also has a zipper system 27 along the bottom edge of each of the two door portions 22,24 and 28,30 which, when the tent is assembled, correspond to the edge of the floor portion 20 thus securing the doors to the floor. The particular advantage of the latter system is that one door may be opened if desired by unzipping the appropriate system while leaving the complimentary door portion closed. Thus, when the tent is constructed over the frame 12, each joint may be securely closed if desired.

The floor of the tent comprises the tubular portion 34 and a fabric material may be placed thereover. Preferably, a one inch layer of soft wool material is placed over the floor portion and may be fastened to or glued on the floor itself to increase the user's comfort.

The covering 10 also has eight holes 31 placed through the door 20 through which the appropriate ground-holding means (as disclosed hereinafter) are inserted. The holes 31 are strengthened and reinforced by placing a metal ring therein through which the ground-holding means are inserted.

The covering 10 may also have a pillow 120 on its inside surface. The pillow 120 in the preferred embodiment of the invention may extend across the central portion of one end of the floor portion 20 or it may be two separate pillows. The pillow may be a separate inflatable area of the floor portion which is inflated in the same manner as the inflatable tubes covering the rest of the covering 10. Also, the pillow may be covered by the soft material (preferably of one inch depth) which is found across the rest of the floor portion. This thus provides a raised portion on the floor of the tent suitable for use as a pillow and removes the necessity of the user of the tent carrying a pillow to the camping ground in addition to transporting the tent.

The present invention further provides novel means to secure the frame 12 of the tent to the ground. There are basically three types of means by which the frame 12 is held to the ground.

The first ground-holding means is used to secure the corners of the frame 12. As shown in FIG. 5, the first means indicated generally at 96 consists of a base plate 36 to which a three-pronged device 38 is affixed near one edge. The device consists of three short hollow tubes 98,100 and 102 joined at one end and short helical springs 44 being inserted one into each tube. The respective frame portions 46,48 and 50 are then inserted into the tubes 98,100 and 102 by depressing the respective springs 44 and therefore are held securely in place by the respective springs.

At the opposite end of the base plate 36, there is provided a ground-insertion means 74. This ground-insertion means comprises a turning or handle means 42 attached to a cylindrical screw 40 which is inserted through a hole 47 in the base plate 36. A hollow expandible plug 76 is attached to the underneath surface of the base plate 36 underneath the hole 48.

The expandible plug 76 comprises two semi-circular complementary sections 78,80 with a screw-thread gap therebetween. The outer diameter of the plug decreases towards its base to a point 52 and as shown in FIG. 7, the inner diameter of the plug tapers inwardly to the point where the outer diameter of the plug decreases towards the point 52. The two sections 78 and 80 are held together by a fixed ring 66 near the top and an expandible ring 104 at the bottom. The threads of the screw 40 cooperate with the screw-threading on the interior of the plug.

The fixed ring 66 and the expandible ring 104 are inset into the two semi-circular complementary sections 78,80 thus providing a smooth ground-insertion means 74.

In order to secure the device in the ground, the expandible plug is inserted into the ground in a suitable manner, such as by percussion. Because the bottom 52 is shaped to a point and the lower portion is of a narrower diameter than the upper, the plug is easily inserted into the ground. The frame is laid out on the ground in an appropriate place and each corner means is placed in the appropriate place. A sharp device may be inserted through the hole 47 to mark in the ground the outline of the hole. The plug 76 is then inserted into the ground in the place corresponding to the hole 47 in the base plate 36. The plug 76 may be inserted by any suitable means including a rubber mallet or similar device.

When the plug 76 is in the ground flush with ground level, the base plate 36 is placed over the top of the plug 76 so that the opening 47 corresponds to the opening of the plug 76. The screw 40 is then inserted through the hole 47 and the handle 42 is turned. Thus, the screw is inserted into the expandible plug. As the screw is inserted further into the plug, the lower portion which was previously contracted by the pressure of the ring 104, begins to expand. This applies outwardly radially extending pressure on the compressible ring which in turn begins to expand. As the screw is tightened further into the plug, the pressure of the plug increases radially outward and provides a very secure fastening means for securing the frame of the tent to the ground. When one wishes to move the tent, it becomes a rather simple procedure to unscrew the screw means which allows the expandible plug and the compressible ring to contract. The plug may be very easily removed from the ground.

The expansion of the plug occurs as follows. When the plug 76 is inserted into the ground, the two complementary portions 78,80 are held together by the combination of the fixed ring 66, the expandible ring 104 and the pressure of the ground itself. When the screw means is inserted into the plug and screwed downwardly, the plug 76 begins to expand. Since the inner diameter of the plug tapers inwardly, and the diameter of the screw means is constant, the insertion of the screw means into the plug causes the lower portion of the plug to expand to accommodate the screw means as shown in FIG. 7. Thus, as the screw means is inserted into the plug, radially outwardly extending pressure is applied by the plug and secures the plug to the ground.

The second ground-holding means for securing the tent frame to the ground is shown in FIG. 6. This means 54 is found at the mid-point along each width portion of the tubular frame 12, in line with the apex of the frame. This means 54 comprises an inverted T-shaped sleeve 106. As seen in FIG. 6, the horizontal frame portions are inserted into the horizontal sleeves with helical springs 56 and 58 to provide a continuous frame portion. The vertical frame portion 60 is inserted into the vertical sleeve to provide support for the front apex of the roof. The expandible plug 62 is of the same structure as the one used for the corner peg except that there is no handle means for the insertion of the screw. The screw means 108 is affixed to the undersurface of the sleeve. When the tent is being constructed, the expandible plug with the fixed and compressible rings is inserted into the ground in an appropriate place. The screw means affixed to the undersurface of the sleeve is then inserted into the plug and the screw means screwed into the plug by rotating the sleeve. This causes the plug to expand to form a firm and secure attachment.

A third ground-holding means is shown in FIG. 7 as 70. A horizontal sleeve 79 encloses tubular frame portions 81 and 83 and an expandible plug as previously disclosed. The screw means 110 is affixed to the bottom of the horizontal sleeve. In order to use this means, the plug is first inserted in the ground in an appropriate place. The screw means 110 is then inserted into the plug and tightened to provide a strong and secure fastening device in the ground. Helical springs 112,114 are then inserted into the sleeve and the horizontal tube portions 81 and 83 are then inserted into the sleeve.

The expandible plug may be constructed of any hard and durable material and is preferably made of steel. It is constructed of two distinct sections which are held together by an expandible ring and a fixed ring. It is very easy to use and most notably, can be removed from the ground with ease.

The frame of the tent may be constructed of any well-known material and is preferably made of aluminium. In the tent of the preferred embodiment, the frame comprises sixteen tubular pieces which fit together as shown in FIG. 4. It has been found that the top longitudinal portion may be made of two pieces of equal length with a coupling 121 joining the two pieces. This provides for easier assembly and handling as well as simplying the method of manufacture.

The stability of the tent may be increased further by running guy wires 116,118 from the top of the front and rear vertical poles to the ground. To secure the wires 116,118 to the ground, the novel expandible plug of the present invention may be utilized instead of the usual tent peg.

Figure 1:
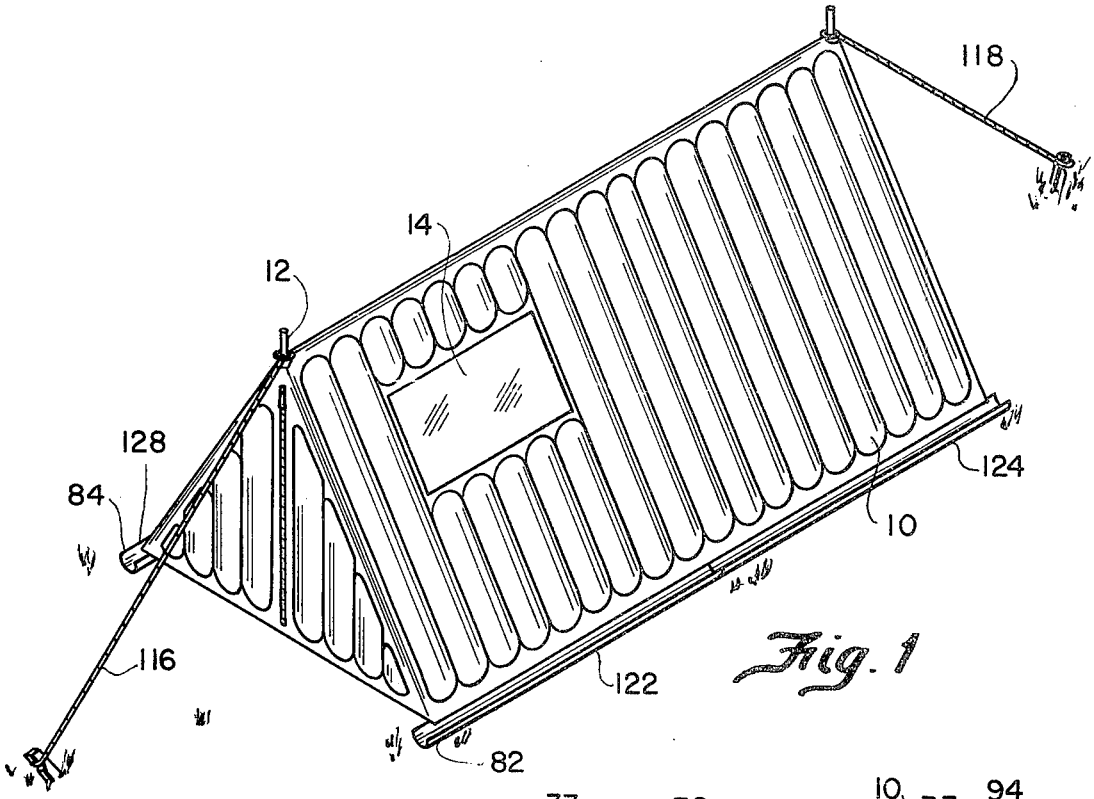
FIG. 1 is a perspective view of a tent according to the present invention.

The drainage problem of the tents of the prior art has been overcome by the use of eave troughs 82,84. These are placed along the junction of the side walls 16,18 and the ground and are designed to extend to a point removed from the tent as seen in FIG. 1.

Each eave trough 82,84 comprises two portions 122,124 and 126,128 (not shown) respectively. Each of the four portions 122,124,126,128 extends from the central point of tubular frame portion 50 (adjacent to the respective ground-holding means 70), along the tubular frame portion to a point extending beyond the end of the tent as shown in FIG. 1. Thus, when the water runs down the side of the tent, it is carried in the troughs to a point removed from the edge of the tent.

Each portion of each eave trough is held to the covering 10 by any suitable means. One example of such means is to provide eyelets along the length of each trough and to provide screws or similar devices along the undersurface of the covering 10 corresponding to the eyelets in the trough. Thus, once the covering is put into place, the screw device is affixed to the eyelet which will hold the trough in place.

Figure 8A:
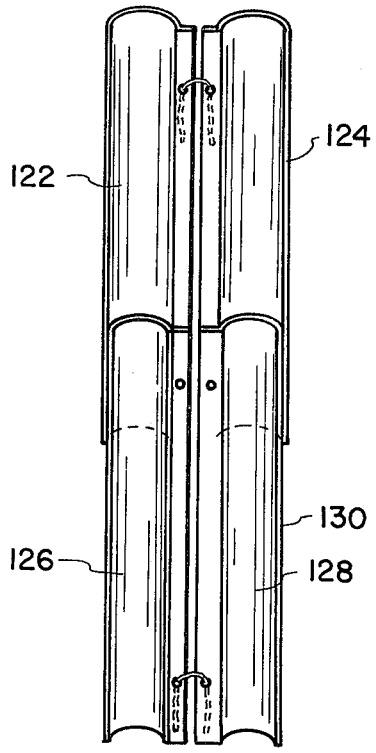
FIG. 8*a* and *b* is an assembled view of the eave troughs fastened together to form a carrying case for the disassembled rib frames.
Figure 8B:
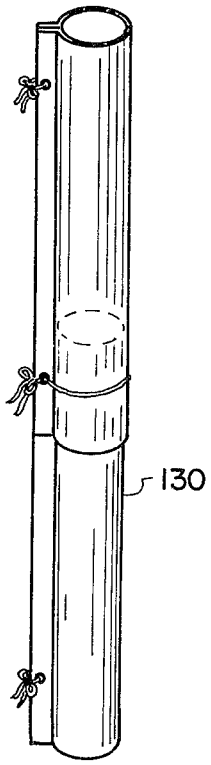

The adjacent ends of each eave trough are adapted to be joined together as shown in FIG. 8*a* as numeral 130 by suitable eyelet and cord means to form a continuous trough. Each of the two troughs are also adapted to be affixed in the longitudinal direction (see FIG. 8*a*) by a similar use of eyelets and cords. Once the troughs are joined in a side-by-side relationship, they may be closed to form a continuous tube (FIG. 8*b*). A cap may be placed over each end and a one-piece carrying tube is formed. The one-piece continuous tube 130 provides a very useful carrying case for the portions of the tent frame when disassembled. Each frame portion is shorter than the length of the tube 130 and therefore fit well within the length of the tube.

Thus, the problem of the collection of the water at the doors of the tent alluded to hereinbefore encountered with tents of the prior art has been effectively eliminated and the solution to that problem provides a further improvement by designing a carrying case for the tubular frame portions when the tent is disassembled.

The tent may also have one or two or more windows 14 in the side portion of the inflatable portion 10 of the tent. These windows may consist of a screen covered by a transparent unbreakable plastic to allow light and/or ventilation. The window 14 may be built into the tent covering 10 as a screen or plastic or it may be of a preferred construction as shown in FIGS. 9 and 10.

Figure 9:
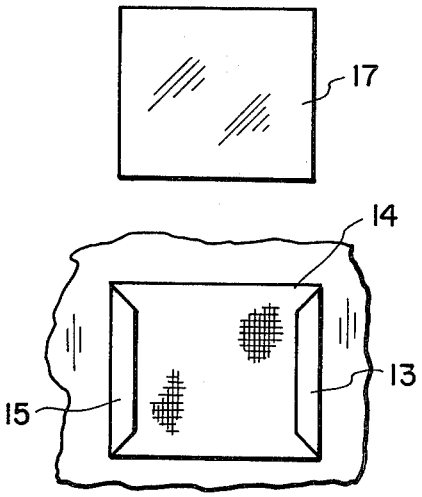
FIGS. 9 and 10 are preferred examples of a window assembly of the tent of the present invention.

FIG. 9 shows a window 14 which is comprised of a screen material with two inwardly turned flanges 13,15 which are adapted to tightly receive a clear plastic sheet 17. This embodiment thus allows the user of the tent to either have a screened window or if the situation warrants it, to merely insert a clear plastic sheet therein to provide a solid air-tight window.

Figure 10:
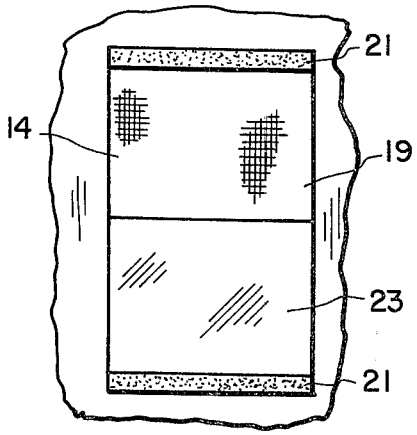

A second preferred embodiment of the window is shown in FIG. 10. This comprises a one-piece arrangement with the actual window being made of a screened material 19 with a relatively thin strip of material 21 such as VELCRO across the top thereof. A similar sized flap of clear plastic 23 is affixed to the lower edge of the screen 19 with a strip of material 21 across its lower edge. When the camper wishes to close the screen window, the flap is raised and fastened to the top strip of material to provide a snug and close fit.

The tent of the present invention is constructed very easily. The camper finds a suitable campsite which does not contain any protruding objects which might pierce the tent floor.

Figure 3:
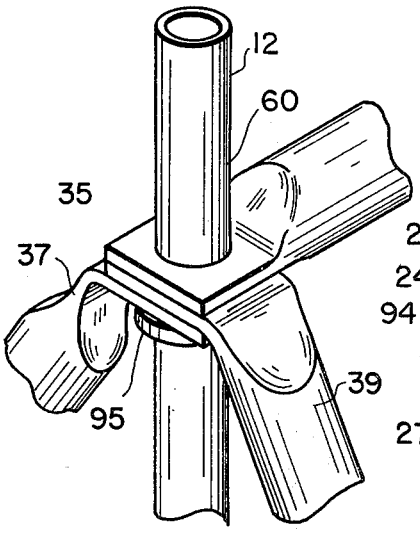
FIG. 3 is a perspective view of an upper corner connection.

The tent floor is laid out as shown in FIG. 2 and the frame portion 12 is assembled thereon. Then, each corner ground-holding means 96, each second ground-holding means 54, and third ground-holding means 70 are placed in the respective holes 31 through the metallic reinforcing ring and then inserted into the ground in a manner described hereinbefore. The frame portion 12 of the tent is then assembled as shown in FIG. 4 and the junctions along the upper ridge of the tent are assembled as seen in FIG. 3. Each tubular frame portion has an upper flat end portion 35,37,39 with a hole therein, the diameter of the hole being marginally larger than the diameter of the vertical frame pole 60. The vertical frame pole 60 carries a ring 95 upon which the frame portions 86,88 and 90 rest.

The helical springs which are inserted in the sleeves, allow the tubular frame portions to be easily inserted into the various sleeves without any need for bending of the frame and allows for a slight margin of error in assembling the position of the frames.

The inflatable covering 10 is then wrapped around the frame portion 12 and the eave troughs 82 and 84 are placed in the appropriate spots as described before. The zippers or fastening devices are then closed to provide a secure and snug fit. The eave troughs are then attached to each side of the tent and the guy wires attached if desired. The seven sections of the covering are then inflated and the tent is fully operable.

Although the disclosure describes and illustrates a preferred embodiment of the invention, it is to be understood the invention is not restricted to this particular embodiment.

What I claim is:

1. An expandible plug for use in securing a tent frame to the ground comprising:

a lower plug means consisting of two symmetrical semi-circular portions, the inside surfaces of which are screw-threaded, and the outer diameter of said lower plug means being reduced towards the lowermost part and terminating in a point, the inner diameter of said lower plug means tapering inwardly to the point where the outer diameter diminishes, said lower plug means having a fixed ring circumferentially affixed to the upper portion of said plug means and an expandible ring circumferentially affixed to the lower portion of said plug means;

a screw means consisting of a uniform cylindrical screw complementary to said screw-threading of said lower plug means;

a handle means adapted to screw said screw means into said lower plug means whereby the lower portion of said lower plug means expands when said screw means is inserted into said lower plug means;

means adapted to secure the frame of the tent to said expandible plug comprising a base plate with a hole therethrough through which the screw means is inserted into said lower plug means, and three short hollow tubes affixed to said base plate adapted to receive respective portions of the tent frame.

2. An expandible plug for use in securing a tent frame to the ground comprising:

a lower plug means consisting of two symmetrical semi-circular portions, the inside surfaces of which are screw-threaded, and the outer diameter of said lower plug means being reduced towards the lower most part and terminating in a point, the inner diameter of said lower plug means tapering inwardly to the point where the outer diameter diminishes, said lower plug means having a fixed ring circumferentially affixed to the upper portion of said plug means and an expandible ring circumferentially affixed to the lower portion of said plug means;

a screw means consisting of a uniform cylindrical screw complementary to said screw-threading of said lower plug means;

a handle means adapted to screw said screw means into said lower plug means whereby the lower portion of said lower plug means expands when said screw means is inserted into said lower plug means, said handle means being an inverted t-shaped sleeve affixed to said screw means, said sleeve adapted to receive said frame of the tent thereby securing said plug to said frame.

3. An expandible plug for use in securing a tent frame to the ground comprising:

a lower plug means consisting of two symmetrical semi-circular portions, the inside surfaces of which are screw-threaded, and the outer diameter of said lower plug means being reduced towards the lower most part and terminating in a point, the inner diameter of said lower plug means tapering inwardly to the point where the outer diameter diminishes, said lower plug means having a fixed ring circumferentially affixed to the upper portion of said plug means and an expandible ring circumferentially affixed to the lower portion of said plug means;

a screw means consisting of a uniform cylindrical screw complementary to said screw-threading of said lower plug means;

a handle means adapted to screw said screw means into said lower plug means whereby the lower portion of said lower plug means expands when said screw means is inserted into said lower plug means, said handle means being a sleeve affixed at right angles to said screw means, said sleeve adapted to receive said frame of the tent thereby securing said plug to said frame.

4. An expandible plug as claimed in claim 3 wherein said sleeve comprises a pair of aligned hollow tubes with a solid central core portion, said tubes each adapted to receive a corresponding portion of a tubular tent frame.

5. An expandible plug as claimed in claim 4 wherein said sleeve contains a short helical spring within each tube between said core portion and said portion of the tubular tent frame.

* * * * *